US005268035A

United States Patent [19]

Neubauer et al.

[11] Patent Number: 5,268,035

[45] Date of Patent: Dec. 7, 1993

[54] METHOD FOR CLEANING METALLIC WORKPIECES

[75] Inventors: Wilhelm Neubauer, Vienna, Austria; Werner Comanns, Korntal-Münchingen, Fed. Rep. of Germany

[73] Assignee: Aichelin GmbH, Fed. Rep. of Germany

[21] Appl. No.: 812,751

[22] Filed: Dec. 23, 1991

[30] Foreign Application Priority Data

Nov. 22, 1991 [DE] Fed. Rep. of Germany ..... 4138432

[51] Int. Cl.[5] ..... B08B 3/00; B08B 3/04; B08B 5/00; C23G 1/14

[52] U.S. Cl. ..... 134/2; 134/10; 134/21; 134/25.1; 134/25.4; 134/26; 134/29; 134/40; 134/73; 134/105; 134/200

[58] Field of Search ..... 134/10, 21, 25.1, 25.4, 134/26, 29, 40, 73, 105, 200, 2

[56] References Cited

U.S. PATENT DOCUMENTS

| | | | |
|---|---|---|---|
| 2,567,820 | 9/1951 | Messerschmidt | 134/163 |
| 3,460,990 | 8/1969 | Barday | 134/40 |
| 5,106,425 | 4/1992 | Sluga et al. | 134/11 |
| 5,137,581 | 8/1992 | Takahashi | 134/40 |

FOREIGN PATENT DOCUMENTS

| | | | |
|---|---|---|---|
| 3715332 | 12/1988 | Fed. Rep. of Germany . | |
| 91177 | 9/1977 | German Democratic Rep. . | |
| 0977374 | 11/1982 | U.S.S.R. | 134/21 |
| 8908163 | 9/1989 | World Int. Prop. O. | 134/40 |

*Primary Examiner*—Theodore Morris
*Assistant Examiner*—Zeinab El-Arini
*Attorney, Agent, or Firm*—Kokjer, Kircher, Bowman & Johnson

[57] ABSTRACT

A method and an apparatus for treating workpieces with a fluid, in particular for cleaning metallic workpieces prior to a subsequent heat treatment are disclosed. According to claimed method the workpieces are positioned in a washing vessel and are entirely overflowed with a pressureless swell of a treating fluid. After a certain period of time, a discharge opening in the vessel is closed so that an immersion bath is filled in. When the workpieces are entirely immersed in the treating fluid, the fluid is agitated by means of air bubbles. During subsequent bath discharge the workpieces are continuously overflowed by the treating fluid in order to avoid chemical reactions with the ambient atmosphere. Finally, the workpieces are dried by means of a vacuum dryer.

19 Claims, 9 Drawing Sheets

METHOD FOR CLEANING METALLIC WORKPIECES

BACKGROUND OF THE INVENTION

The invention relates to a method for treating workpieces with a fluid, in particular for cleaning metallic workpieces prior to a subsequent heat treatment. The invention, further, relates to an apparatus for executing the afore-mentioned method.

A method and an apparatus of the afore-mentioned kind have been known from German trade journal "HTM", 45 (1990), No. 5, page 273.

BRIEF DESCRIPTION OF THE PRIOR ART

Methods and apparatuses for treating workpieces with a fluid (hereinafter referred to as "washing"), in particular for cleaning and/or rinsing metallic workpieces, are typically used in complex heat treatment installations. Heat treatment installations of this kind may, for example, be vacuum heat treatment furnaces, push-through-furnaces, roller hearth furnaces, vertical retort furnaces or multi-purpose chamber furnaces, for effecting blank annealing heat treatment, various annealing methods, hardening processes as well as diffusion processes like nitriding, nitrocarburization, carbonitriding and carburization.

According to prior art apparatuses and methods of the kind mentioned at the outset, one has used baths that were selected primarily under the aspect of their effectivity whereas in earlier times questions of natural raw material resources and, in particular, environmental aspects were considered to be of less importance. Therefore, one has earlier used for the cleaning of metallic workpieces chlorinated hydrocarbons, for example tetrachlorethen (Per) or trichlorethen (Tri) which were considered to be ideal cleaning agents, in particular for the removal of grease and pigment dirt whereas their negative properties with respect to environmental questions became known only later and were only later taken into account.

Under the aspect of environmental questions many countries have in the meantime adopted legislation aiming at the reduction or the prohibition of chlorinated hydrocarbons, in particular tetrachlorethen and trichlorethen as well as halogenated hydrocarbons.

Moreover, trichlorethen in the meantime is suspected to cause cancer so that this cleaning agent has been entirely withdrawn from commerce within Europe.

In the meantime, many countries of the earth have adopted a strict legislation with respect to environmental questions. In the Federal Republic of Germany, for example, the 2nd Federal Emission Protection Rules have stipulated that fluorchlorinated hydrocarbons, having been used as cooling agents as well as 1.1.1-trichlorethan, having been used as a cleaning agent, may no more be used after a very short transitional period.

In the United States of America the "Clean Air Act" was amended on Oct. 27th, 1990 and its supplements became effective by the signature of President Bush on Nov. 15th, 1990. These amendments to the law correspond to a substantial restriction of the Federal U.S. legislation as of 1977. For example, section III enumerates various commerces that shall be subjected to the law with different priority. The degreasing and the metal cleaning businesses are identified thereunder with priority number 1. In this connection chlorinated hydrocarbons are explicitly mentioned, in particular trichlorethylen. The law provides for a drastic reduction of the production and sales of such agents and, for example, based on a 100% production quantity of 1989 that shall be reduced to 15% in 1997. The law provides for stiff punishments in case of any violation of the law.

On the other hand side, during the heat treatment of metallic workpieces, the workpieces have to be thoroughly cleaned prior to the heat treatment or have to be subjected to another surface treatment, in particular, when they had been subjected to another working method before, for example forging, lathing, milling or grinding.

During such machining processes, various soilings of the metallic workpieces may occur. For example, such soilings may consist of cooling lubricants, greases of any kinds, lapping pastes and pigments or hardening oils, dusts and metal chips. If such workpieces shall be subjected to a subsequent surface treatment, it is absolutely mandatory to first remove any such soilings from the workpiece surface. For, soiled surfaces would affect the heat treatment effect, in particular during nitriding, nitrocarburization or carburization. During the hardening processes (diffusion processes) mentioned before, substances like e.g. nitrogen and/or carbon will penetrate by means of diffusion processes from the exterior of the surface into the outer surface layers of the metallic workpiece. If, however, the surface is soiled over certain areas, the diffusion, being directed from the exterior of the workpiece, in particular during gas nitrocarburization, may not be effected or will be substantially slowed down. As a result, workpiece surfaces are obtained which are not or only partially hardened in the area of the soilings.

A clean workpiece surface is also mandatory for vacuum heat treatment, blank annealing and other surface coating processes.

Considering the problems mentioned before, one has since some time made considerable efforts to develop cleaning agents under environmental aspects, for example on the basis of water which, on the one hand side, have no problems for people getting into contact with same but, on the other hand side, guarantee good cleaning results.

Such water-soluble cleaning agents, e.g. highly washing-active substances containing mostly tensides, have a reduced ability of dissoluting greases, as compared with chlorinated hydrocarbons such that the cleaning process must be assisted by a relative motion between the workpieces to be cleaned and the cleaning fluid and, further, highly concentrated solutions of such agents have to be used.

According to prior art installations for the cleaning of metallic workpieces, the relative movement between the workpiece and the cleaning fluid is effected by spraying the fluid from swivable arms with a high fluid exit velocity. In such a way, the workpieces are sprayed with the treating fluid and the cleaning effect is a combination of a mechanical action on the pollutant particles with a chemical reaction. However, a negative side effect of the high fluid exit velocity and the high spraying intensity is that oils and greases emulgate which deteriorates the bath quality.

Moreover, for the treatment of workpieces have a complicated shape, e.g. crank shafts and pressure housings with bearing locations, it has turned out to be necessary to use complicated mechanical installations with swivable hinged spraying arms in order to reach all of the workpiece surface and to clean it accordingly by mechanical impingement of spraying liquid. Further, it is relatively complicated and difficult with this prior art method to clean bulk products or stacked charges because even if the spraying arms were articulated along several axes, it would be very difficult and, in some instances, impossible to reach each and every inner surface of workpieces stacked as a charge because the innermost workpieces within a stacked charge are protected by other workpieces therearound so that even if the cleaning fluid were sprayed with a high pressure and high velocity, it would not impinge on those workpieces within the center of the charge.

Further, installations have been known in which the entire charge or the entire bulk products were immersed into a bath and the relative movement between the workpieces and the cleaning fluid was effected by pumps, propellors, recycling installations or jets or by lifting and lowering the entire charge within the bath.

However, in spite of these considerable technical efforts one has found that there is no or only very little flow within a charge so that the agitated fluid will mostly flow around the outer charge contour without penetrating into it.

One has, further, become aware that when cleaning solutions based on water and comprising highly washing-active substances are used which, in turn, have many ionic components, some kind of grease film will remain on the workpiece surface even after numerous rinsing steps due to the strong ionic counteraction between the washing-active substances and the metallic surface. This grease film, however, influences e.g. a subsequent gas nitriding diffusion process. As a result, it could, therefore, even be that the cleaning substances themselves, after having removed any pollutants from the workpiece surface, will now influence the workpiece surface themselves.

Another problem that occurs when metallic workpieces are cleaned is that the workpieces have to be dried after cleaning and, if necessary, rinsing.

In prior art installations the metallic workpieces were taken from the bath or the spraying apparatus and were then dried by means of heated circulated air or by strong blowing. Considering that the workpieces at this stage are normally at elevated temperature, the evaporation process of the remaining fluid is assisted by the elevated temperature.

However, this prior art methods have the disadvantage that the workpieces have to be exposed to the atmosphere for a certain amount of time. Moreover, it is impossible to entirely dry workpieces being packed in charges with high density, or so-called "scooping" workpieces, i.e. workpieces having countersunk holes, concave horizontal surfaces or the like containing considerable amounts of liquid even after the workpieces were lifted off a bath.

In such cases, even after a relatively short period of time, modifications on the workpiece surface may occur because fresh washed and rinsed metallic workpieces are highly active at their surfaces so that even after a very short period of time corrosion stains may be observed. If, in addition, cleaning or rinsing liquids are used containing soluted salts, such salts may give rise to salt stains on the dried workpiece surface. This, also, will result in considerable problems during a subsequent diffusion heat treatment.

Moreover, prior art heating systems, for example heating systems using heated circulated air, have a high energy consumption and a very low duty factor.

Another problem arising during conventional cleaning of metallic workpieces is that cleaning agents being normally used may only be applied within a certain temperature range. If, for example, the cleaning bath has a too high temperature (approx. 100° C.), the cleaning agents will be chemically modified and their cleaning activity will be drastically reduced. If, on the other hand side, the cleaning bath has a too low temperature (below the cloud point or a little bit above), the cleaning effect will also be reduced because the washing activity is no more sufficently assisted thermically. Moreover, at a too low temperature, greasy pollutants will become too viscous which also negatively effects the chemical cleaning.

From German trade journal "HTM", 45 (1990), No. 5, page 273, mentioned at the outset, a method and an apparatus for the cleaning of metallic workpieces have been known which partially obviate the drawbacks explained before. The prior art apparatus uses a washing vessel within which the workpieces remain during cleaning, rinsing and drying. During cleaning and rinsing, the workpieces are kept within an immersion bath being agitated by the jetting-in of air from the vessel bottom as well as by circulating the liquid. A vacuum drying is used for drying the workpieces.

This prior art method has the advantage that by injecting air a sufficient agitation of the treating bath is achieved because the rising air bubbles will carry along pollutant and dirt particles by means of adhesion forces even if they are heavier than the treating fluid itself. Further, by keeping the workpieces in one and the same vessel for cleaning, rinsing and drying, the workpieces will come into contact with the ambient atmosphere only to a very little extent. Finally, the vacuum drying method allows drying with very little energy consumption.

However, this prior art apparatus as well as the method used therein, have the disadvantage that no sufficient cleaning action is possible during the first and very important phase of the cleaning process, i.e. the flooding of the vessel and, in particular, with respect to coarse pollutants and dirt, and that during the subsequent method steps the contact between the wet workpieces and the ambient atmosphere still lasts a certain period of time and that, finally, the workpieces at certain surface areas (countersunk bores, cavities, scooping surfaces) are not sufficiently exposed to the agitated bath.

East German patent specification 91 177 describes a method for cleaning office machines and similar mechanical instruments. According to this prior art method, the office machines are cleaned in a bath in which bubbles rise which are generated by a pulsed gas stream.

French patent specification 1 410 251 describes a cleaning apparatus for hospital instruments which uses agitation of the cleaning bath by means of pressurized air causing the cleaning liquid to flow around and through syringes etc.

U.S. patent specification 2 567 820 describes a cleaning apparatus for small machine components comprising a basket-like recipient receiving the machine components and having a bottom formed by a grill. An annular tube is located beneath the grill and is provided with exit openings for allowing air bubbles to rise therefrom and through the grill.

German utility model document 84 37 870 describes an apparatus for washing metallic workpieces using jets to spray washing fluid on the workpieces with a speed between 18 and 55 m/s.

German disclosure document DE-OS 37 15 332 discloses a method and an apparatus for the cleaning of workpieces, wherein the workpieces are immersed in a bath into which air or another gas is injected. The pollutant particles are taken along with the gas bubbles and are separated from the bath by means of an overflow.

SUMMARY OF THE INVENTION

It is, therefore, an object underlying the invention to provide for an apparatus and a method of the kind mentioned at the outset, obviating the drawbacks and disadvantages explained hereinbefore so that the cleaning effect of metallic workpieces is generally improved.

According to the method specified at the outset, the invention provides for a solution of this object by the following method steps:

a) positioning of said workpieces in a washing vessel having a capacity between 1 $m^3$ and 10 $m^3$;
b) closing said washing vessel;
c) entirely overflowing said workpieces with a pressureless swell of a first treating fluid, preferably a cleaning fluid, having a temperature between 50° C. and 90° C., said swell being set to a flow rate between 100 and 300 cubic meters per hour per square meter of workpiece surface, for a duration of between 1 and 10 minutes, said first treating fluid being continuously discharged from said washing vessel via an outlet tube;
d) closing said outlet tube and allowing said washing vessel to be filled by said swell up to an overflow;
e) reducing said flow rate by 30 to 80%;
f) injecting gas from a bottom of said washing vessel for letting gas bubbles flow around said workpieces, for a duration between 3 and 15 minutes;
g) opening said outlet tube and simultaneously increasing said flow rate up to 80% to 100% according to step c) for allowing said washing vessel to discharge;
h) concurrently with steps c) through g) continuously cleaning and recycling said first treating fluid discharged or overflowing, respectively, from said washing vessel;
i) if need be, repeating steps c) through h) one or more times with a second treating fluid, preferably a rinsing fluid; and
k) air-tight closing said washing vessel and generating therein a vacuum between 60 and 350 mbar, for a duration of between 3 and 10 minutes.

The object underlying the invention is, thus, entirely solved.

For, during the first and very critical phase of the treating, e.g. during the cleaning step, the overflowing of the workpieces with a pressureless swell of a very large flow rate has the effect that the workpieces will be treated or cleaned, respectively, to a very large extent such that any subsequent steps, e.g. cleaning steps, can already start from workpieces being substantially clean or at least much cleaner as has been the case with prior art attempts.

The pressureless swell overflowing the workpieces with a very large flow rate, further, penetrates into areas of the workpieces, otherwise inaccessible for generating whirls therein and for taking along pollutant particles. This is impossible with prior art apparatuses where very thin fluid jets are directed with high pressure onto the workpiece, because in such cases only a very small point-shaped workpiece surface area is subjected to the treating fluid, whereas the remaining, in particular the inner areas of the workpieces, are inaccessible.

As compared with the other prior art of injecting air or gas into the fluid, the method and apparatus according to the invention have the advantage that the workpieces will be overflown or flooded or inundated already prior to the filling in of a cleaning bath, thus during a period of time where the injecting of air would have no effect at all, because there is not yet any bath filled-in into the vessel.

Moreover, the subsequent method steps have the advantage that the workpieces are permanently held below a fluid, even during the discharging of the treating bath such that no unwanted chemical reactions may occur on the workpiece surface.

Another essential advantage of the method according to the invention is that the treating bath is continuously cleaned in parallel, during any method steps where the cleaning fluid is used. In such a way, an entirely autonomous system is established having no need for being fed with supplemental treating fluid. It goes without saying that the method according to the invention is not restricted to a particular sequence of washing or rinsing steps. Instead, the method according to the invention can be used for washing with subsequent rinsing or for pre-washing, intermediate-washing and post-washing with or without intermediate or subsequent rinsing steps. Moreover, the method according to the invention may be used in connection with heat treatment processes, as is preferred with the invention, however, it can also be used in connection with other manufacturing or treating processes.

According to a preferred embodiment of the inventive method, a desalinated water is used as said second treating fluid, a washing agent being added to said desalinated water after step i) for being used as a washing fluid during a subsequent execution of said method.

This feature has the advantage that even a "used" rinsing bath may subsequently be used as a cleaning bath where entirely desalinated water would be a perfect basic substance for a cleaning fluid.

According to another preferred embodiment of the invention, a bubble stream is generated having bubbles with a diameter of about 1 mm.

This feature has the advantage that as many gas bubbles impinge per workpiece surface unit as necessary for effecting an intense liquid movement with a high solution effect, whereas, on the other hand side, the flowing fluid together with the impinging gas bubbles will create a mechanical cleaning effect.

According to another embodiment of the invention, said gas is injected into said fluid with a pulsed increased pressure.

This feature has the advantage that the pulsed injection of gas results in an increased mechanical cleaning effect. The pulsed injection e.g. guarantees that gas bubbles adhering to the metallic workpiece surface will be separated therefrom either mechanically or through pressure variations so that the adhering gas bubbles may be replaced by a cleaning fluid or other highly accelerated gas bubbles impinging on the metal surface.

According to another preferred embodiment, the gas is air.

This feature has the advantage that a low-cost gas can easily be supplied at any time.

According to one more embodiment of the invention, the gas is a protective gas showing no chemical reactions with surfaces of said workpieces and/or does not assist such chemical reactions.

This feature has the advantage that, if metals or metal alloys are used which, e.g., are sensitive against oxygen, or where oxygen together with water will generate microscopic corrosion, as may be the case with inferior ferrous alloys, these materials may be cleaned without generating modifications on their surface during the cleaning step.

According to another embodiment of the invention, the liquid is water.

This feature has the advantage that the solvent for the cleaning agent is a low-cost liquid having no problems under environmental aspects and can be used without any problems by human operators. However, also other cleaning agents with or without additives or water together with washing-active substances may be used.

According to one more preferred embodiment, the cleaning fluid is water, a soft, grease-solvent cleaning agent being added to said water, said cleaning agent showing no chemical reactions with surfaces of said workpieces and/or does not assist such chemical reactions.

This feature has the advantage that after the termination of washing processes, no residues of the cleaning agent will remain on the surface.

According to one more preferred embodiment, the cleaning agent is neutral or alkaline.

This feature has, on the one hand side, the advantage that metals or metal alloys, respectively, are not attacked by water media within this range of the pH-value and, on the other hand side, that such media are neutral under environmental aspects and are not hazardous for persons handling same.

According to another preferred embodiment of the invention, the injected gas has the same temperature as said treating fluid.

This feature has the advantage that in connection with the elevated process temperature as compared with normal temperature, a lower solubility of gases within the fluid is to be observed so that gases which normally would tend to solute under pressure in a fluid would possibly not solute but rather flow through the fluid as gas bubbles.

According to another preferred embodiment of the invention, the workpieces is a bulk material and is filled in a fluid-permeable drum, said drum being immersed in said treating fluid with said bubbles passing therethrough.

This feature has the advantage that by means of the additional movement of the bulk material within the drum a particular intensive mixing and whirling of the workpieces, the fluid and the gas flow is achieved. In such a manner it is, for example, possible to perfectly clean even smallest parts like bolts or the like with cutted threads.

The object underlying the invention is, further, solved according to an apparatus mentioned at the outset and having the following features:

- a washing vessel being adapted to be closed in an air-tight manner;
- a support arranged in said washing vessel for receiving said workpieces;
- at least one treating fluid tank;
- a pressureless swell fountain arranged above said support;
- a first duct-and-valve-system for interconnecting said tank with said swell fountain;
- a second duct-and-valve-system for interconnecting said tank with an outlet tube of said washing vessel;
- a third duct-and-valve-system for interconnecting said tank with an overflow of said washing vessel;
- a gas injector being arranged in said washing vessel adjacent said support;
- a fourth duct-and-valve-system for interconnecting said gas injector with a gas tank;
- a vacuum pump;
- a fifth duct-and-valve-system interconnecting said vacuum pump and the interior of said washing vessel; and
- control means for programmably controlling said first, second, third, fourth, and fifth duct-and-valve-system.

These features have the advantage that it is only necessary to modify few elements of prior art installations, in particular to provide for a pressureless swell fountain or shower and an appropriate pump-duct-and-valve-system with sufficient capacity to generate the required pressureless water swell with a very high flow rate. A particular advantage of the inventive apparatus as well as of the inventive method is that both the apparatus and the method are modular with, on the one hand side, prior art installation components or method steps, respectively, that can almost arbitrarily be combined with new and inventive installation components or method steps, respectively, in order to custom-tailor a respective apparatus or method for a specific fluid treating purpose. Consequently, the apparatus and the method according to the invention may extremely well be adapted to particular needs and may be extended or otherwise modified by rearranging the various components or method steps, respectively, if after a first treating process has been executed for a certain amount of time, another fluid treating process shall be initiated.

According to a preferred embodiment of the inventive apparatus, the gas injector has a wall facing the treating fluid as being provided with openings for letting the gas flowing therethrough.

This feature, known per se, has the advantage that the gas stream for agitating the bath is generated over a large surface thus affecting the entire washing vessel interior.

This holds true in particular when the perforated wall covers the entire washing vessel bottom surface.

According to a further embodiment of the invention, the wall, further, extends laterally in the washing vessel adjacent a vertical wall thereof, the bubbles being ejected therefrom in a horizontal direction and at a predetermined speed such that said bubbles flow at least into a center of the washing vessel.

This feature has the advantage that if, e.g., circular cylindrical vessels are used, the gas bubbles are injected not only from the bottom but, additionally, from a lateral direction such that they reach, at least, the central vessel axis, as viewn in a horizontal direction. Due to the gas bubbles' buoyancy, an ascending bubble path is generated. In such a way, even upper surfaces of concave design may be cleaned.

According to another preferred embodiment of the inventive apparatus, the gas injector is a double-walled body having a wall surface facing the treating fluid and being provided with openings.

This feature has the advantage that a simple and robust apparatus is obtained which can possibly be mounted into existing washing vessels so that, e.g., conventional vessels being still equipped with mechanical transportation and agitating means may be upgraded accordingly.

According to one more preferred embodiment of the inventive apparatus, the double-walled body is subdivided into sections being individually fed with the gas.

This feature has the advantage that depending from the kind and the dimensions of the workpieces to be cleaned, gas streams of different and adapted shape may be generated.

Finally, another embodiment of the invention is preferred where the gas injector is designed as a porous ceramic.

This feature has the advantage that no complicated hollow body must be provided, because in a porous ceramic the gas bubbles will be dispersed by themselves.

Other advantages of the invention will become apparent from the description and the enclosed drawing.

It goes, however, without saying that the features that have been explained hereinbefore and that will be described hereinafter may not only be used in the combination, as explicitly specified, but, in contrast, may also be used in other combinations or even alone, without departing from the scope of the invention.

DESCRIPTION OF THE INVENTION

Illustrative embodiments and exemplary applications will now be described with reference to the accompanying drawings to disclose the advantageous teachings of the present invention.

Figure 1:
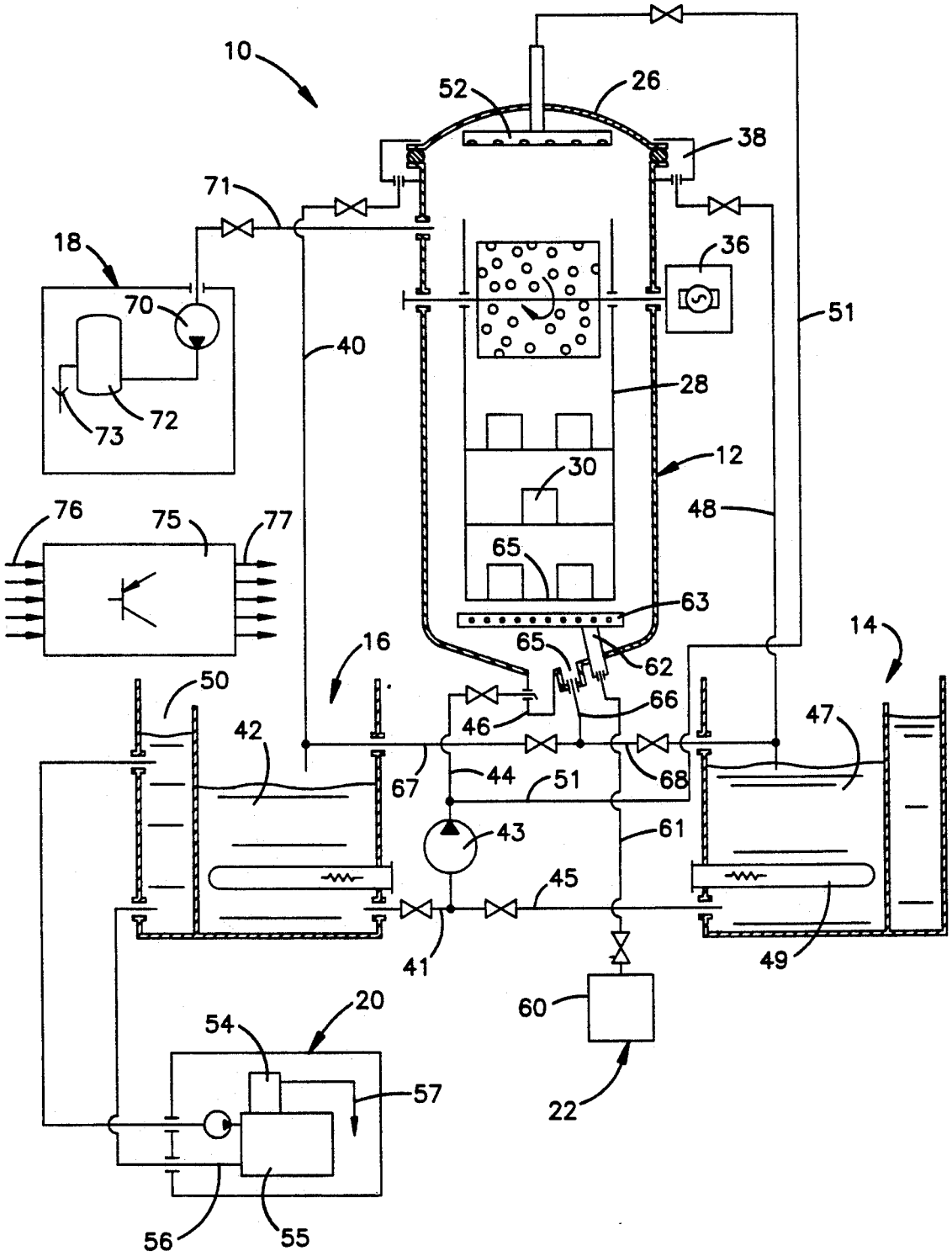
FIG. 1 is an extremely simplified and schematic view showing an embodiment of an apparatus for cleaning metallic workpieces.

FIG. 1 shows an installation 10 comprising a washing vessel 12, a first tank 14 for a first treating fluid, a second tank 16 for a second treating fluid, a vacuum unit 18, a filter unit 20 and an apparatus 22 for injecting gas into washing vessel 12.

Washing vessel 12 is circular in cross-section and is covered at its upper end with a cover 26. Within the interior of washing vessel 12, a support 28 is arranged serving to receive a charge of workpieces 30. Support 28 may be inserted from above in a vertical direction into washing vessel 12 when cover 26 is opened and may be removed therefrom, respectively.

Workpieces 30 are, preferably, metallic workpieces, i.e. conventional machine parts that shall be subjected at a later stage to a heat treatment, e.g. a nitrocarburization. Workpieces 30, according to their specific design, may, therefore, be provided with hollow cavities, bores or other hollow areas that are opened upwardly, downwardly or sidewards.

Moreover, support 28 bears a drum 32 being provided with a horizontal shaft 34. Shaft 34 extends laterally through the wall of washing vessel 12 for being driven by a drive 36 outside washing vessel 12.

Drum 32 receives workpieces in the form of bulk material, not shown in further detail. Drum 32 is designed such that it is provided with openings at its periphery such that fluid and gas bubbles may penetrate therethrough, whereas bulk materials being contained in drum 32 are retained.

Washing vessel 12 at its upper rim is provided with an overflow 38. In the drawing, overflow 38 is shown as extending at the outer periphery of washing vessel 12. However, according to another preferred embodiment of the invention, the overflow may also be arranged at the inner periphery of washing vessel 12. If this is done, the overflowing will occur within the interior of washing vessel 12, thus facilitating various treating methods, in particular methods utilizing vacuum technology.

Overflow 38, on the one hand side, is connected with second tank 16 via a duct 40. Second tank 16 in the shown embodiment comprises a cleaning fluid 42. On the other hand side, overflow 38 is connected with first tank 14 via a duct 48. In the shown embodiment, tank 14 is provided with a rinsing fluid 47. Ducts 40 and 48 are provided with valves for either opening or closing the connection between overflow 38 and tanks 14 or 16, respectively, as will be explained in more detail below.

Second tank 16 containing cleaning fluid 42 is connected with the suction inlet of a pump 43 via a duct 41. The outlet of pump 43 is connected with a tube section 46 via a duct 44, the tube section 46 being arranged in the bottom of washing vessel 12. Between tank 16 and pump 43 as well as between pump 43 and tube section 46, valves are provided, as will be explained in more detail below.

Pump 43 with its suction inlet is, further, connected with rinsing fluid 47 containing first tank 14 via a duct 45.

Tanks 14 and 16 are both provided with heating means arranged at a bottom thereof.

As shown with reference to second tank 16 in FIG. 1, tank 16 is provided with a lateral pre-separator 50 being connected via an overflow with the main interior of tank 16. Pre-separator 50, further, is connected with tank 16 via a duct and a pump (not shown) such that fluid may be pumped from pre-separator 50 into tank 16. Tanks 14 and 16 are both provided with a skimmer such that pollutants or soilings or dirt floating on the fluids 42 and 47, respectively, will be transported into pre-separator 50. Pre-separator 50, in turn, is provided with a skimmer for collecting and discharging pollutants.

Moreover, pre-separator 50 is connected with filter unit 20 which, in turn, is provided with a filter 55 and an oil separator 54. Filter unit 20 is not mandatory for the operation of installation 10, but may be a useful option.

Filter 55 serves to separate solid substances from the fluid coming from pre-separator 50. Oil separator 54 is used to separate oily components from the fluid. Separated oil components are discharged via oil remover 57 so that they may be properly be transported to a waste disposal. Any fluid exiting from filter 55 can be recycled to tank 16.

Vacuum unit 70 is provided with a vacuum pump 70 being connected with the interior of washing vessel 12 via a duct 71. Preferably, duct 71 communicates with the interior of washing vessel 12 shortly below overflow 38.

The pressure side of vacuum pump 70 is provided with a condenser 72 as well as a collector 73. Duct 71 is provided with a valve, as will be explained below.

Washing vessel 12 may be closed by cover 26 together with overflow 28 in an air-tight manner.

Gas injector 22 comprises a pressure tank 60 containing gas under pressure. Pressure tank 60, in turn, may be connected to a compressor (not shown). Further, it is possible to use a blower. The gas used in injector 22 is preferably compressed air, however, one can also use non-reacting protective gases. Further, it is possible to design gas injector 22 such that the gas is heated up before it is injected into washing vessel 12.

Pressure tank 60 is connected with an inlet tube section 62 arranged in the wall of washing vessel 12 via a duct 61 comprising respective pressure control and pressure reduction valves, respectively. From tube section 62, a duct 61 is directed to a plate-shaped hollow body 63 being arranged in the vicinity of the bottom portion of washing vessel 12. Plate-shaped hollow body 63, extending essentially in a horizontal direction, preferably occupies the entire inner cross-section of washing vessel 12 adjacent its bottom. In any case, the dimensions of hollow body 63 should be at least as large as the dimensions of support 28, as viewed in a vertical direction.

Plate-shaped hollow body 63 according to preferred embodiments of the invention may be designed from stainless steel metal sheets with the stainless steel metal sheet being the upper plate surface is provided with openings 65. Openings 65 are bores having a diameter of approximately 1 mm and being separated from each other by a distance of preferably 25 mm.

As an alternative to hollow body 63 made from stainless steel metal sheets, one can also use a porous ceramic (not shown) arranged around an air distribution tube. If this is done, the air will penetrate through the pores of the porous ceramic and will be distributed homogeneously.

Finally, installation 10 is provided with an electronic control apparatus 75 having inputs 76 to input method parameters and having outputs 77 for controlling the various components of installation 10, in particular the numerous valves and pumps.

Various methods as may be executed with the installation 10 of FIG. 1 shall now be described in further details using the method step illustrations of FIGS. 2 through 7.

For the preparation of the inventive method, cover 26 of washing vessel 12 will be opened (not shown) for inserting support 28 with workpieces 30 from above by means of a crane or the like.

As soon as this is done, washing vessel 12 will be closed by closing cover 26. During this phase of the inventive method, the closure must not be air-tight, but should be closed to an extent for being a splash guard.

Figure 2:
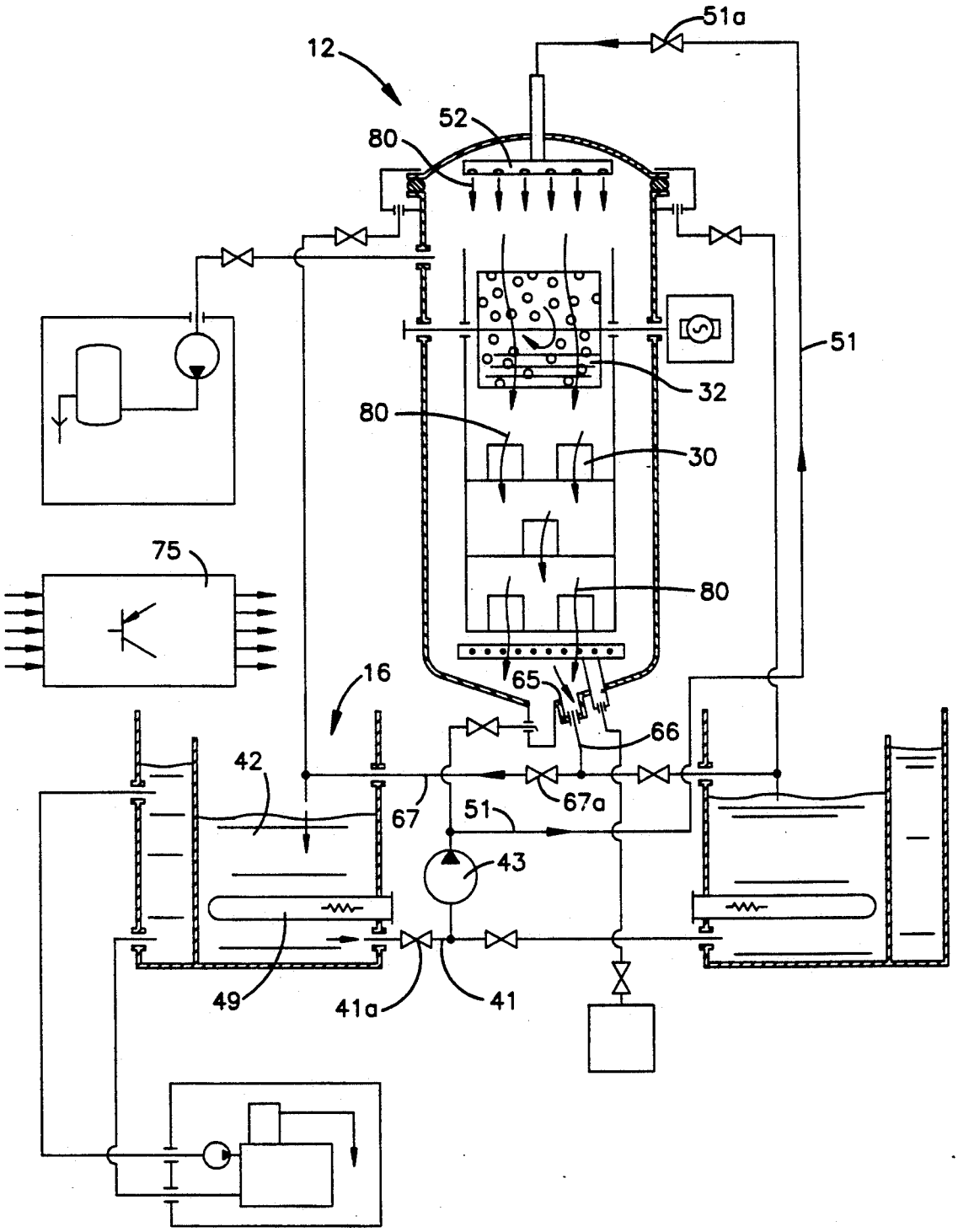
FIG. 2 is a view, similar to that of FIG. 1, for further illustrating the method step "pressureless overflowing"

FIG. 2 shows the first substantial method step.

Control apparatus 25 having been programmed with the required method parameters, will first, as a preparative step for the execution of the method, switch on heating 49 in second tank 16 containing cleaning fluid 42. In parallel, heating 49 in first tank 14 containing rinsing fluid 47 will also be switched on, if a rinsing step is required. In such a way, cleaning fluid 42 and, if need be, rinsing fluid 47 will be heated up to a temperature of between 50° C. and 90° C., preferably in the range between 80° C. and 90° C. This is a temperature range within which the cleaning agent and the rinsing agent (if the latter is used) have their optimum range of operation, because the said agents will be chemically altered at higher temperatures and will have a much lower cleaning and rinsing activity at lower temperatures.

As soon as liquids 42 and, if need be, liquid 47, are on required operation temperature, control apparatus 75 will open the required valves. First, a valve **41*a* in duct 41 will be opened to connect second tank 16 with the suction side of pump 53. Further, a valve 51*a* in duct 41 will be opened for connecting the pressure output side of pump 43 with swell fountain 52. Finally, a valve 67*a* in duct 67 will be opened for connecting tube section 65 of washing vessel 12 with second tank 16 via duct 66. Tube section 65** in so far acts as a discharge.

As a consequence of these commands, a circulation of cleaning fluid 42 is set running from second tank 16 over valve **41*a*, duct 41, pump 43, duct 51 and valve 51*a* to swell fountain 52. The pump power of pump 43 and the flow cross-sections of valves 41*a* in 51*a*, respectively, are set by means of electronic control apparatus 75 such that a pressureless swell 80 of cleaning fluid 42 exits from swell fountain 52**, the flow rate of which being between 100 $m^3/h$ and 300 $m^3/h$ per square meter of workpiece surface.

Swell 80 will overflow or inundate workpieces 30 in a pressureless manner for then returning via tube section 65, acting as a discharge, and via ducts 66 and 67 and opened valve **67*a* into second tank 16**.

Workpieces 30 are, therefore, pre-cleaned by means of pressureless swell 80, because swell 80 takes along all adhering dirt or other solid pollutants, in particular pigments, but also greases and will discharge same.

Cleaning fluid 42 preferably consists of a water solution comprising an additive of non-foaming neutral cleaner with a temporary corrosion protection. Such a neutral cleaner has a relatively weak emulgating effect on oils, however, it has no problems under environmental aspects and will not attack the workpieces to be cleaned nor would it be hazardous to those persons handling these fluids in any way. The weak alkaline temporary corrosion protection will remain as a thin protective layer on the workpieces but will be later on entirely evaporated without any remains at temperatures above 300° C.

The method step, described hereinbefore in connection with FIG. 2 will be executed during a period of time of preferably between 1 minute and 10 minutes.

As soon as this period of time has lapsed, control apparatus will switch over to the next method step, as will be explained with respect to FIG. 3.

During this next method step, the connection between second tank 16 via pump 43 to swell fountain 52 will remain unchanged. However, in contrast to the preceding method step, valve **67*a* in duct 67 will be closed so that washing vessel 12** is not discharged.

As a consequence, washing vessel 12 will be repleated with an immersion bath 83, the level 85 of which ascending continuously, as depicted in FIG. 2 by means of arrow 86.

Washing vessel 12, therefore, will be continuously filled with a warm cleaning immersion bath 83, and this method step will last as long as a level sensor (not shown) detects that liquid level 85 has reached overflow 38. As soon as this is the case, this method step is terminated.

Figure 4:
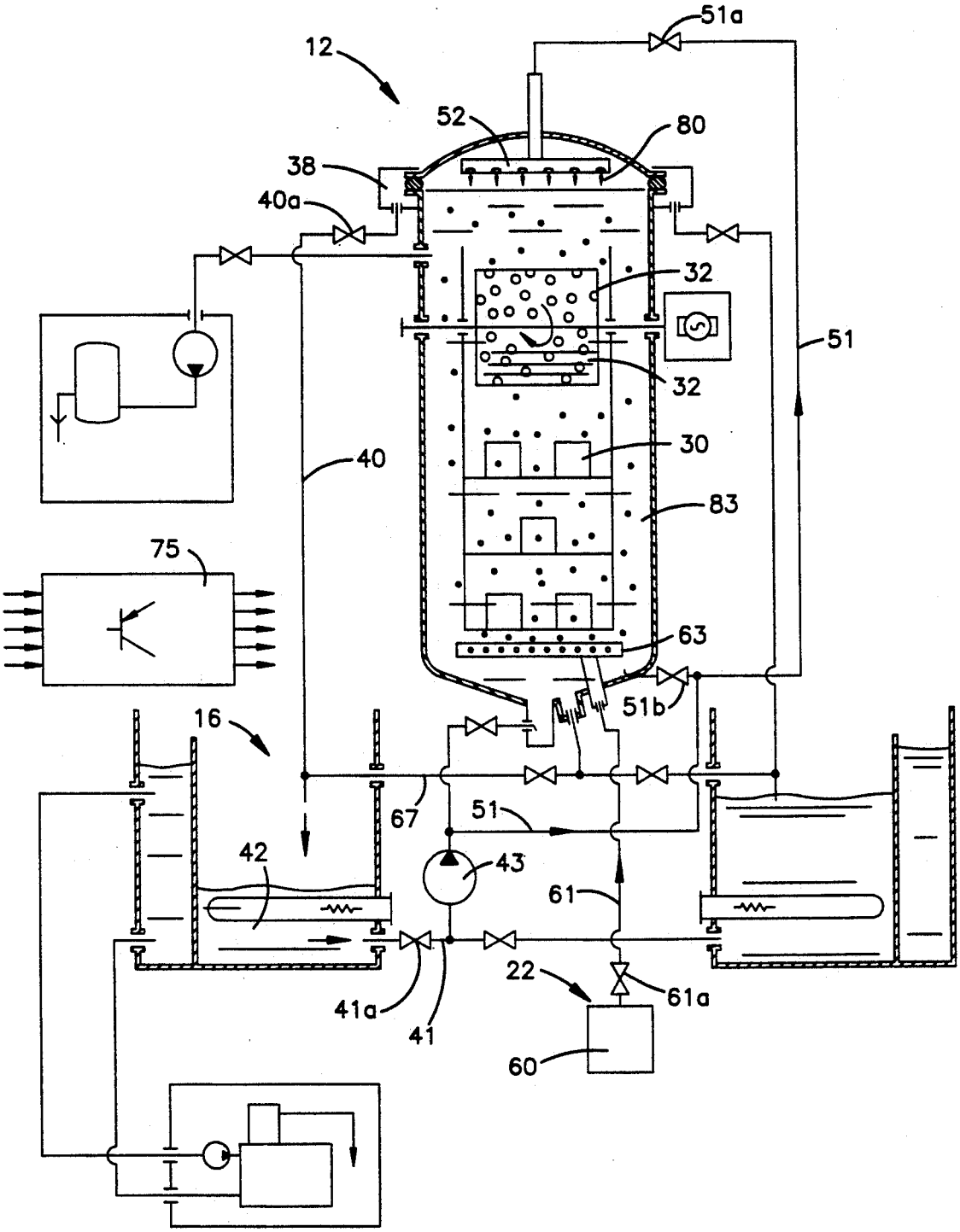
FIG. 4 is a view, similar to that of FIG. 1, for further illustrating the method step "circulating with gas bubble agitation"

FIG. 4 shows the next method step during which bath 83 is circulated and agitated.

For circulating bath 83, the connection between second tank 16 and swell fountain 52 will be maintained, however, by e.g. decreasing the pump power of pump 43 by e.g. between 30% and 80%, the flow rate is reduced so that substantially reduced swell 80' will exit from swell fountain 52.

Now, control apparatus 75 will open the valve 40*a* in duct 40 between overflow 38 and second tank 16 so that cleaning fluid 42 overflowing over overflow 38 will be discharged into second tank 16.

As soon as liquid level 85 has reached overflow 38, in one alternative embodiment valve 51*a* in duct 51 at swell fountain 52 can be closed and a connection valve 51*b* may be opened, interconnecting pressure outlet side of pump 53 with the bottom of washing vessel 12. By doing so, the liquid supply from the bottom of washing vessel 12 will have the effect that only such liquid being provided with rising gas bubbles having pollutants adhered thereto will exit from washing vessel 12 but not such liquid fed to swell fountain 52 which would directly be discharged via overflow 38 in a short-circuit manner.

Concurrently, control apparatus 75 will activate gas injector 22 by opening a valve 61*a* in duct 61 between pressure tank 60 and plate-shaped hollow body 63.

As a consequence, gas bubbles will exit from plate-shaped hollow body 63 to a large extent and will flow around workpieces 30 by simultaneously agitating cleaning bath 83.

The pressure of the gas or the air, respectively, exiting from plate-shaped hollow body 63 is set to be slightly higher than the ambient hydrostatic pressure at openings 65. The compressed gas or air will exit from the very many openings 65 as small gas bubbles for then rising due to the exit pressure and due to their buoyancy with increased velocity up to overflow 38.

Those air bubbles impinging on the underside of workpieces 30 will be deflected sidewardly such that a dense stream of bubbles will rise along the vertical walls or bores of workpieces 30 if these are arranged vertically or inclined to a vertical axis. Due to adhesion forces and due to turbulences within the fluid, the gas bubbles will also be directed along the upper surface of workpieces 20 so that there, too, a strong agitating of the cleaning fluid 42 will occur.

Due to the numerous impingement locations of support 28 as well as of workpieces 30, supported therein, the air bubbles, exiting from openings 65 will not take a linear path upwardly but will be deflected numerous times and will propagate along a serpentine and turbulated path.

The air bubbles, further, will penetrate trum 32 so that the bulk material, contained therein, will also be subjected to the air bubbles when drum 32 rotates.

For agitating cleaning bath 83, valve 61*a* may be permanently opened by control apparatus 75, wherein the agitation intensity may be fed in a predetermined manner by setting the valves accordingly. As an alternative, it is also possible to intermittently open and close valve 61*a* such that pressure pulses are fed to hollow body 63. One can, for example, set the pulses such that every 10 to 15 seconds compressed air is injected into washing vessel 10 for a short period of time with a pressure of between 5 and 10 mbar above ambient hydrostatic pressure.

When workpieces 30 are provided with solid dirts as pigments, sand, drilling chips or grinding chips, one can, in an initial phase of the cleaning process, operate with very high pulsed pressure and high frequencies. Due to the intense turbulations, the solid particles will be separated from workpieces 30 just by mechanical action. Further, one has found that the solid pollutant components, although they have a higher density as compared with the cleaning fluid 42 contained in washing vessel 12, will be transported up to the surface due to adhesion forces, because the solid components tend to adhere to the gas bubbles and are, therefore, transported to overflow 38 together with the latter. From then on, the pollutants will be transported to tank 16 via duct 40. However, if the workpieces to be cleaned are extremely dirty, one can provide for a coarse filter at overflow 38.

Due to the use of non-foaming neutral cleaning agents, as described above, it is ensured that even during intensive air injection into washing vessel 12 no excessive foam is generated.

Considering that cleaning fluid 42 is on operational temperature, workpieces 30 will be degreased by means of the washing-active substances within the cleaning agent, e.g. by anionic tensides, thus removing greasing oils and the like from workpieces 30.

It goes without saying that the quantity of circulated liquid being supplied by pump 43 during this method step, may be adjusted according to the degree of dirt on the workpieces. The pump power of pump 43 may, further, be varied over the duration of this method step by e.g. first operating at a higher flow rate and, subsequently, with a reduced flow rate.

The method step, explained before, in connection with FIG. 4 will preferably be executed during a period of between 3 and 15 minutes.

Figure 5:
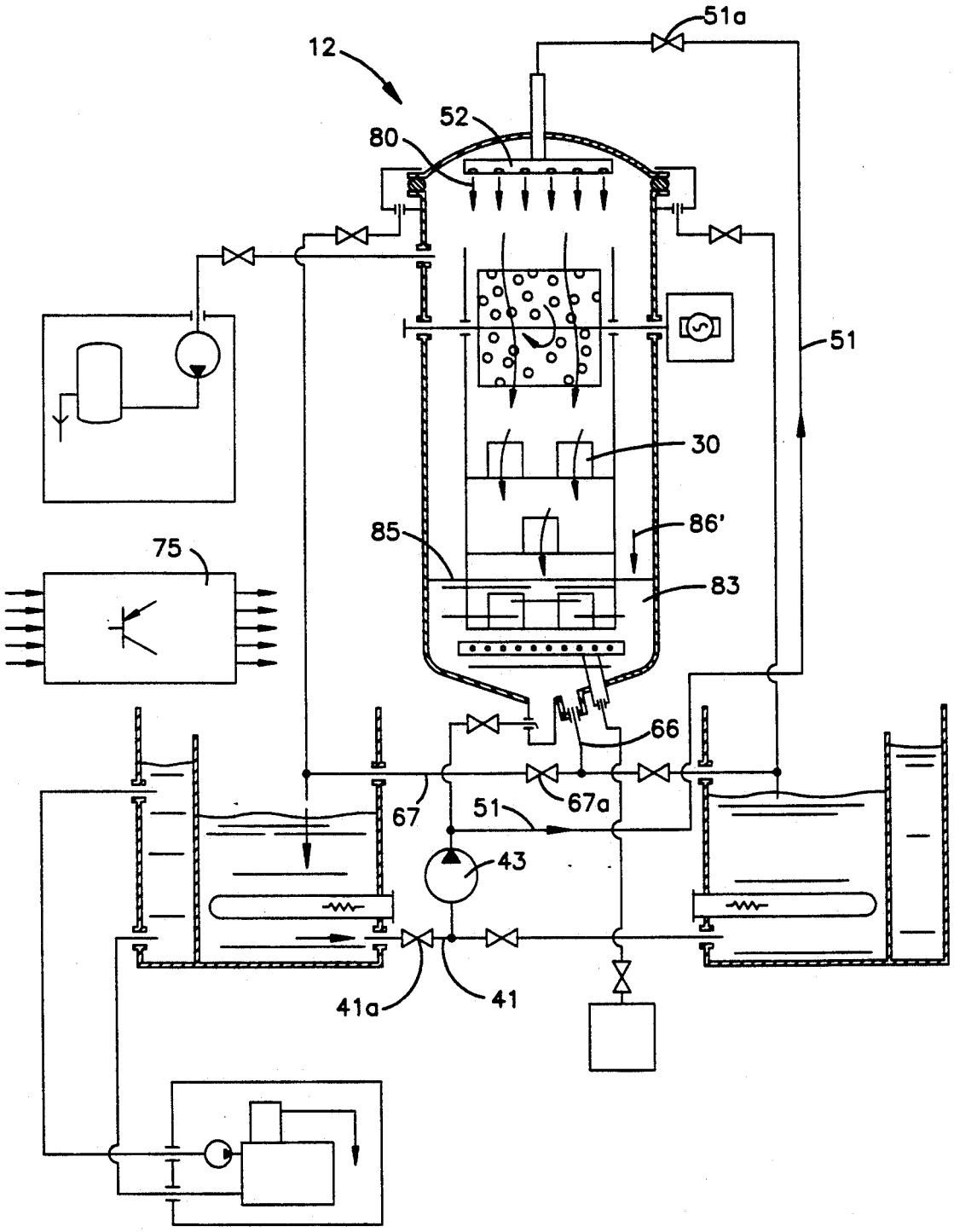
FIG. 5 is a view, similar to that of FIG. 1, for further illustrating the method step "pressureless overflowing and discharging"

After this period of time has lapsed, control apparatus 75 will switch over to the next method step, as explained with respect to FIG. 5.

Figure 3:
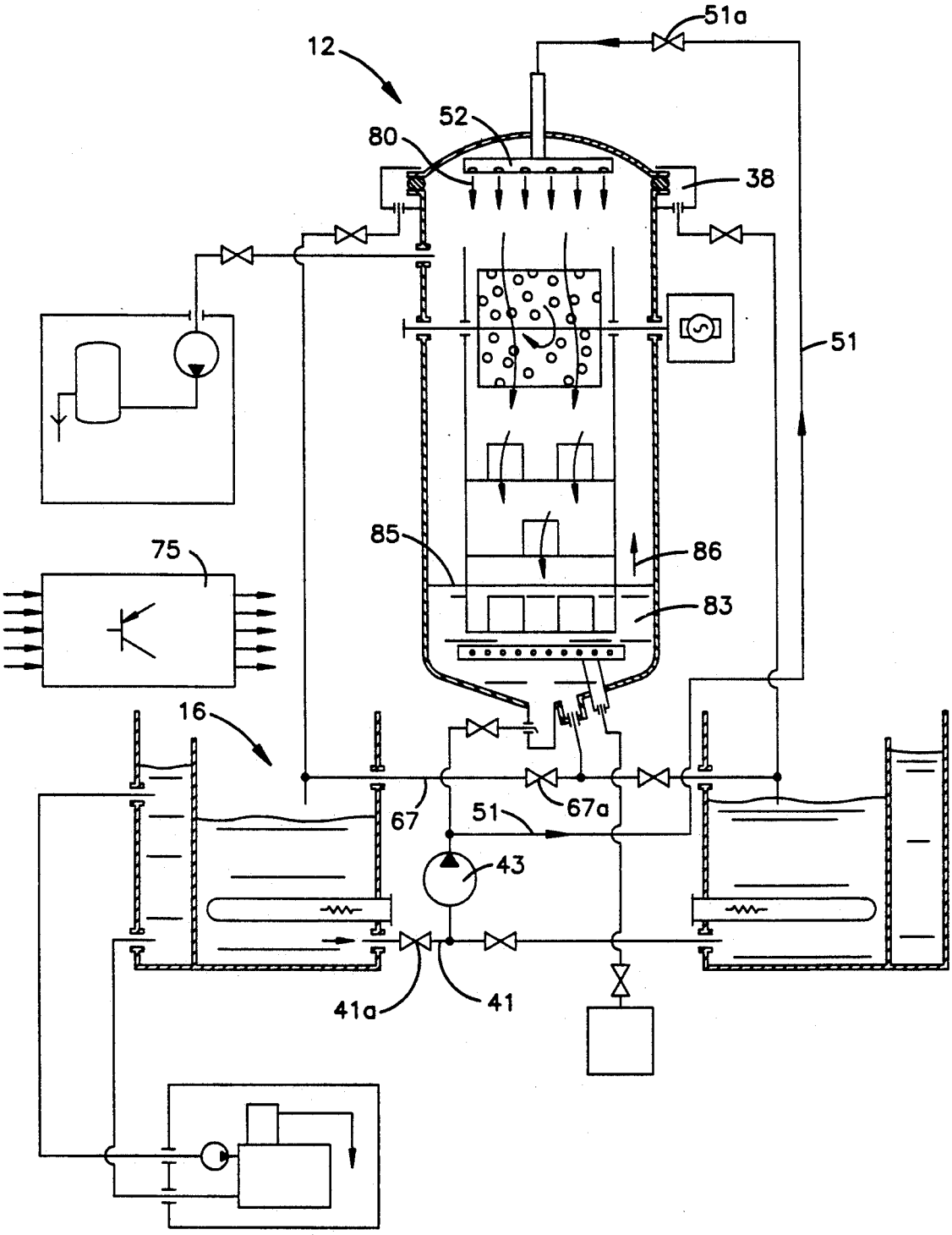
FIG. 3 is a view, similar to that of FIG. 1, for further illustrating the method step "pressureless overflowing and filling-in"

For this purpose, control apparatus 75 will switch pump 43 to a pump power corresponding entirely or mostly to the pump power during the method step explained with respect to FIG. 3. Accordingly, a swell 80 exits from swell fountain 52 having a flow rate of between 100 and 300 $m^3/h$ per square meter of workpiece surface. However, concurrently valve 67*a* within duct 67 is opened so that bath 83 is discharged from washing vessel 12, as indicated by a downwardly directed arrow 86' at liquid level 85 in FIG. 5.

The permanent pressureless overflowing or inundation of workpieces 30 during the discharging step of FIG. 5 is made for the following reasons:

When during discharging of bath 83 liquid level 85 will descend, it could be that dirt particles rising up during discharging, will deposit on workpieces 30 when liquid level 85 passes same. However, this is prevented when sufficient fresh, i.e. cleaned cleaning liquid 47 is supplied from above, namely from swell fountain 52, because then workpieces 30 are permanently overflown during the discharge of bath 83.

On the other hand side, the permanent provision of pressureless swell 80 guarantees that workpieces 30 will not or almost not come into contact with ambient air. For, during the discharge of bath 83, one has to allow air entering the interior of washing vessel 12 so that bath 83 may be discharged. However, when fresh air enters washing vessel 12, it could create chemical reactions on the surfaces of workpieces 30 which, at that time, are highly active. Chemical reactions of this kind would, however, be entirely unintended. Therefore, it is highly useful to overflow workpieces 30 continuously and without pressure during discharging of bath 83.

Figure 6:
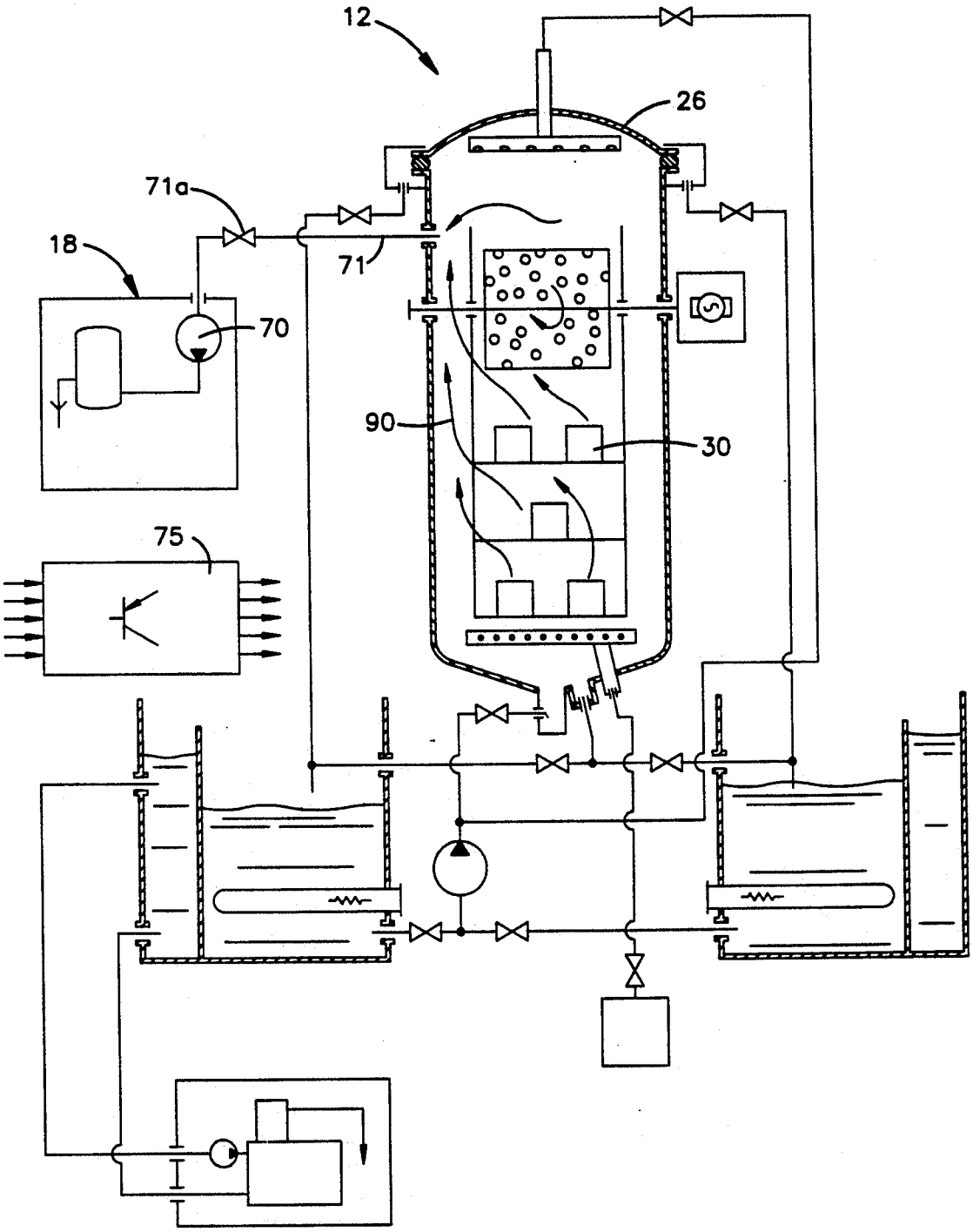
FIG. 6 is a view, similar to that of FIG. 1, for further illustrating the method step "vacuum drying"

As soon as bath 83 is entirely discharged, as can be detected by means of appropriate level sensors (not shown), control apparatus 75 will switch into the next method step, as shown in FIG. 6.

During this method step, cover 26 of washing vessel 12 must be closed in an air-tight manner.

Control apparatus 75 will open valve 71*a* in duct 71 between the interior of washing vessel 12 and vacuum pump 70. Concurrently, vacuum pump 70 is activated.

At this stage, one has to bear in mind that workpieces 30 at this time have the temperature of bath 83, i.e. they are at an elevated temperature of e.g. between 80° C. and 90° C.

Vacuum pump 70 will now generate a vacuum within the interior of washing vessel 12. At a vacuum pressure of about 800 mbar, the evaporation of the residual liquid on workpieces 30 will start, and the resulting water steam will be sucked off via duct 71 as indicated by arrows 90 in FIG. 6. Vacuum pump 70 will now further lower the pressure within washing vessel 12 down to 200–300 mbar, corresponding to vapor pressure at a water temperature of between 60° C. and 80° C. The remaining liquid on workpieces 30 will now evaporate with the evaporation being faster on plane surfaces, as compared with evaporations within bores, hollow cavities or so-called "scooping surfaces", i.e. sunk areas of the workpiece surface opening upwardly.

The drying step will be performed for a period of time of between 3 and 10 minutes. As soon as all of the fluid has evaporated from workpieces 30, the pressure within the interior of washing vessel 12 will drastically decrease down to 70–80 mbar, because there is no more liquid to evaporate. By means of an appropriate time control or by means of an appropriate pressure sensor (not shown), this pressure decrease may be detected, and the drying step may be terminated accordingly by control apparatus 75.

Depending on which method is executed, one can now or before the afore-explained drying step provide for further treating steps with other treating fluids, e.g. one can provide for a rinsing of workpieces 30 by means of rinsing fluid 47 contained in first tank 14. In so far, the method steps would be the same as described before with respect to FIGS. 2 through 5.

However, the following is of importance:

During the entire method, in particular during the method steps in which the bath 83 is circulated, the respective fluid, e.g. cleaning fluid 42, will be continuously cleaned, as explained at the outset with respect to filter unit 20 of FIG. 1.

Therefore, installation 10 may operate entirely autonomously, i.e. there is no need of feeding or discharging treating fluids to and from the installation 10, respectively, during its operation.

Only when one of the fluids can no more be used, e.g. due to aging thereof, it must be either treated accordingly or it must be discharged and replaced by a fresh treating fluid. However, during the normal operation of installation 10, one has only to care for the discharge of pollutants, dirts, and greases filtered off as described before.

Moreover, it would be advantageous to use entirely desalinated water as a basis for the treating fluids. The desalinated water may first be used as a rinsing fluid 47, because it is thus prevented that during drying (FIG. 6), salt stains remain on the workpieces which could negatively affect subsequent heat treatment, in particular nitrocarburization.

Rinsing fluid 47 even if it can no more be used as such, could then be used as a cleaning fluid 42 by adding appropriate cleaning agents for subsequent cleaning processes. By doing so, one and the same liquid is used for an extremely long period of time without the necessity of providing fresh liquids.

Figure 7:
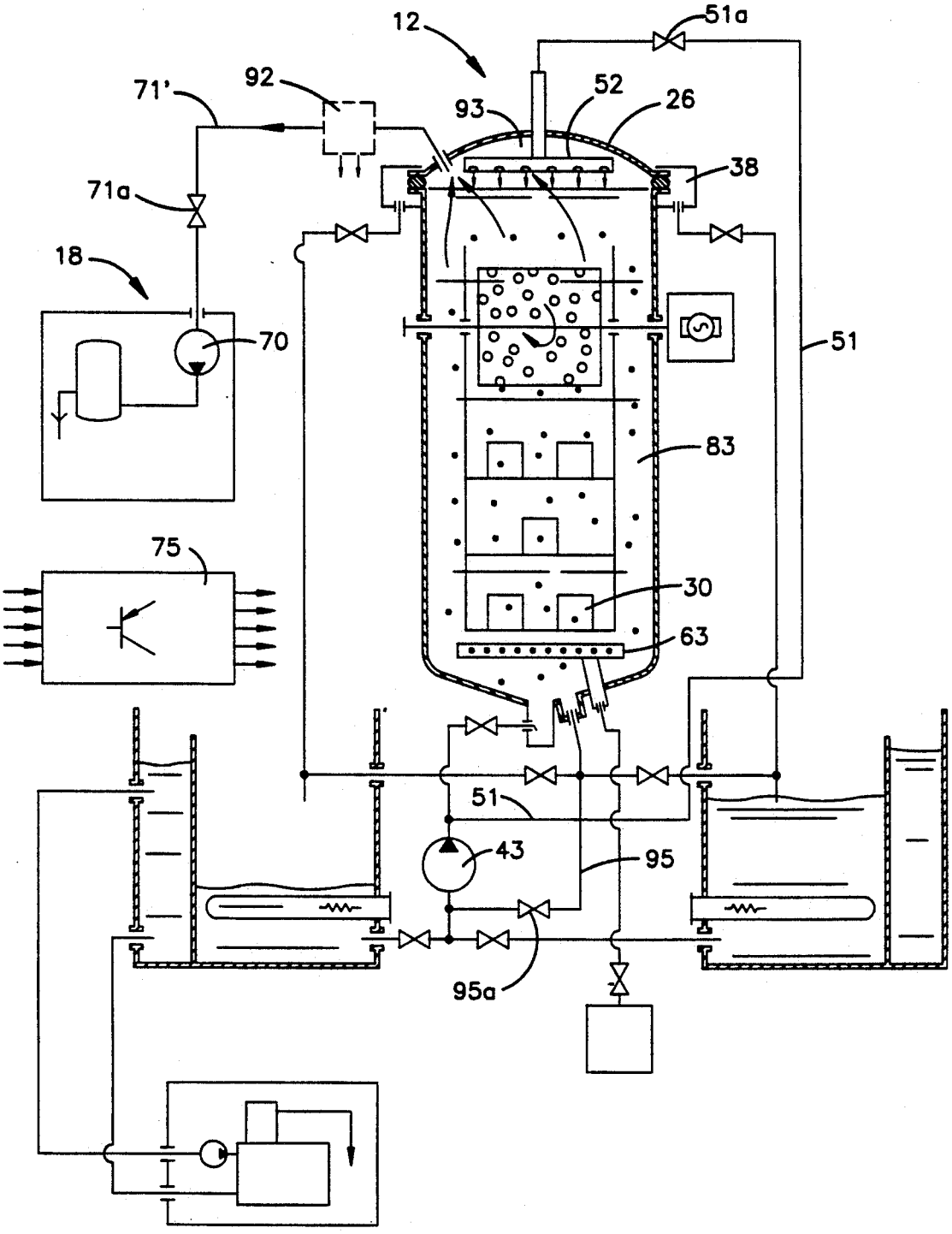
FIG. 7 is a view, similar to that of FIG. 1, for further illustrating the method step "vacuum boiling"

FIG. 7 shows a preferred embodiment for agitating bath 83.

According to the embodiment shown in FIG. 7, duct 71' interconnecting vacuum pump 70 and washing vessel 12 is preferably attached to cover 26.

The method step shown in FIG. 7 and explained hereinafter is considered to be an alternate solution or a supplement to the method step of agitating described above in relation to FIG. 4.

According to the method step shown in FIG. 7, vacuum pump 70 is activated by control apparatus 75 for agitating bath 73 and, concurrently, valve 71*a'* in duct 71' is opened.

Considering that during this phase of the method, bath 83 is entirely filled in up to overflow 38, vacuum pump 70 will generate a strong vacuum within the remaining small air space 91 in the area of swell fountain 52.

The vacuum will now be set such that bath 83 will start to boil in spite of its temperature being considerably below the temperature of 100° C., being the boiling temperature of water under atmospheric pressure. In order to do so, the vacuum has to be set such that it corresponds to the saturation vapor pressure of water at the prevailing lower temperature where, additionally, the hydrostatic pressure within washing vessel 12 has to be taken into account, e.g. the height of the liquid within the interior of washing vessel 12.

If, for example, the temperature of bath 83 is 85° C., this would correspond to a saturation vapor pressure of 600 mbar. If the liquid column within washing vessel 12 has a height of 2 m, one has, in addition, to subtract another 200 mbar of hydrostatic pressure, resulting to a required vacuum of 400 mbar. At 80° C. temperature of bath 83 and a saturation vapor pressure of 500 mbar, the required vacuum will be 300 mbar when having deducted 200 mbar as a compensation for the hydrostatic pressure of 2 m water column.

If, therefore, the vacuum is set to be 400 (85° C.) or 300 (80° C.) mbar, respectively, bath 83 will start to boil, although its temperature is well below 100° C.

Due to the boiling of bath 83, vapor bubbles will be generated at each location within bath 83, i.e. not only on surfaces of workpieces 83, but, further, within cavities, bores, countersunk bores, scooping cavities, and the like. The vapor bubbles, therefore, are also generated at such surface locations of the workpieces which would not be accessible to air bubbles as generated by air injector 22 described above. Further, vapor bubbles rising up to the surface will also take pollutant particles along due to adhesion forces so that also countersunk bores an scooping areas will be cleaned, because all dirt particles will be removed. It goes without saying that the boiling intensity may be set by properly setting the vacuum via vacuum pump 70. The pollutant and dirt raised by means of vapor bubbles during such vapor-boiling will be collected on the bath surface and can be removed after the termination of the boiling phase by means of overflow 38 from washing vessel 12, as has been described above.

Boiling of bath 83 may be provided as well during cleaning as well as during rinsing, because during cleaning the chemical cleaning process is assisted, whereas during rinsing those portions of the workpieces that are difficult to access will be entirely rinsed as described before. It goes without saying that also during the vacuum-boiling bath 83 can be cycled and/or additionally agitated.

For doing so, the suction input of pump 43 will be connected to tube section 65 via a duct 95 with a valve 95*a* being inserted therein.

When the suction power of pump 43 is sufficient, one can, in spite of the vacuum prevailing within washing vessel 12, suck a corresponding amount of treating fluid from tube section 65 which can then again be injected into washing vessel 12 by means of swell fountain 52. Of course, one can, during this phase of the method, care for a permanent cleaning of the respective treating fluid during recycling (not shown).

Further, it would be appropriate to insert a condenser 62 into duct 71', because vacuum pump 70 will suck vapor of the respective treating fluid, and such vapor should not enter into vacuum pump 70. Therefore, one would allow some air to enter into washing vessel 12 such that vacuum pump 70 will always suck a mixture of air and vapor with the vapor being condensed in condenser 92 for then being recycled to the respective tank of treating fluid. This measure has the advantage that the treating fluid does not become thicker, i.e. does not show an increasing salt content, because the water loss is kept as low as possible by recycling evaporated and condensed treating fluid.

The vapor quantity for vacuum pump 70 will then be reduced by the condensed amount of vapor such that vacuum pump 70 may be dimensioned small which is advantageous under economical aspects.

Considering that vacuum pump 70, as already mentioned before, can only pump-off saturated air, the air needed for vacuum pump 70 will be inserted into washing vessel 12 via hollow body 63. In so far it is possible to dimension the amount of air required by vacuum pump 70 to correspond to the amount of air needed for floatating bath 83.

The method by step of vacuum-boiling, described before, in relation to FIG. 7 can be integrated and incorporated in various ways into the remaining method steps described before in relation to FIGS. 2 through 6.

According to a first alternative, the vacuum boiling may be used permanently during the immersion of workpieces 30 so that same are boiled permanently during the entire cleaning and rinsing time.

According to a second alternative, the vacuum boiling can be used during immersion of the workpieces as an addition to the floatation, i.e. only for a limited fraction of the cleaning and rinsing time.

According to a third alternative, the vacuum boiling can be applied by properly setting the control apparatus 75 in a pulsed manner, be it during the entire cleaning and rinsing time or during fractions thereof. Pulsed vacuum boiling may be achieved by strongly evacuating washing vessel 12 until the boiling effect starts or almost starts for then causing a boiling-up by abrupt addition of fresh air, i.e. by abrupt relieving the pressure.

Fresh air, in so far, may be fed to washing vessel 12 either via hollow body 63 or via swell fountain 52.

Moreover, according to a fourth alternative, the vacuum boiling during immersion of the workpieces may be used additionally to the agitating and cycling of the bath by means of injected air.

The method step of vacuum boiling may last between 1 and 20 minutes.

Figure 8:
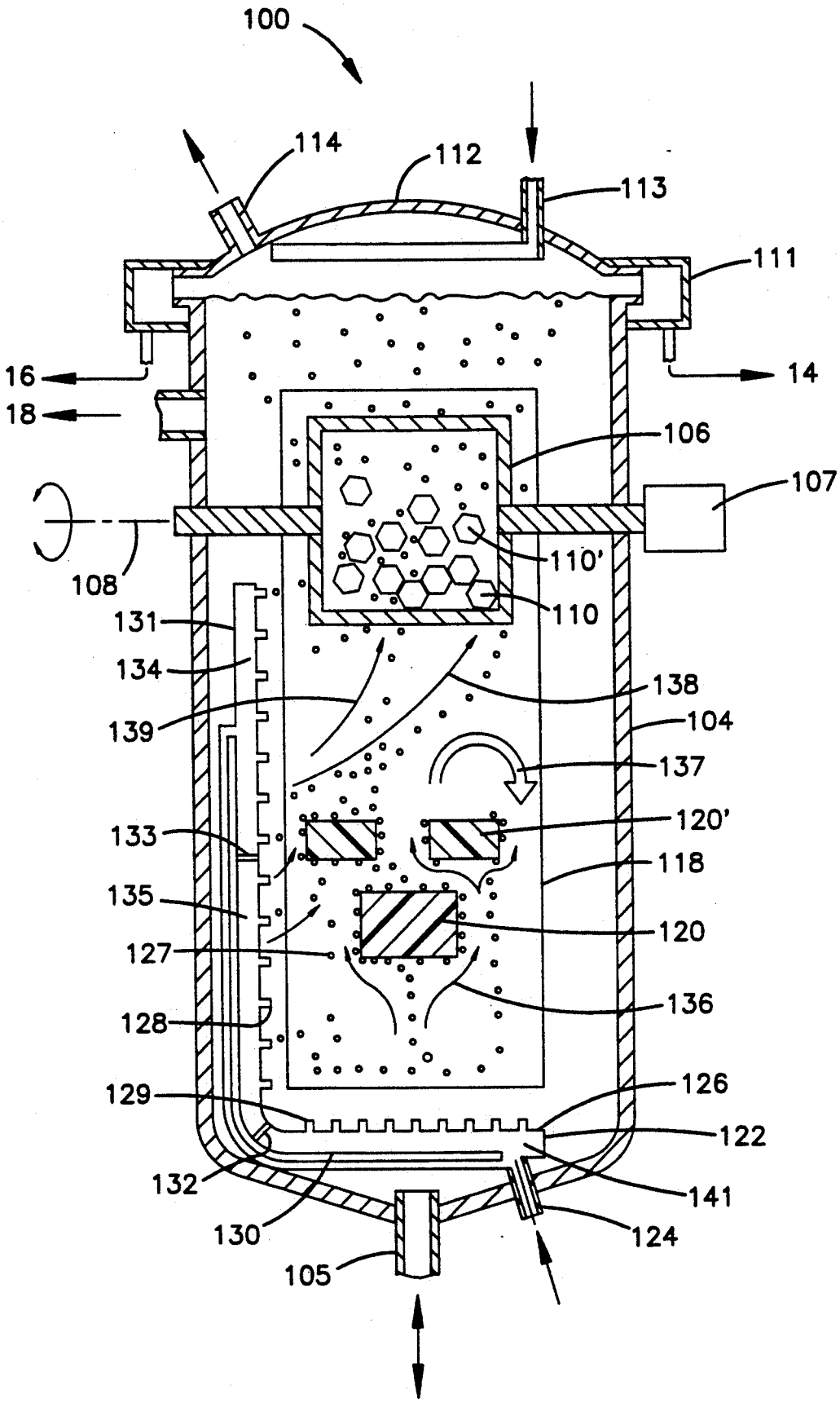
FIG. 8 is a modification of the cleaning vessel of FIGS. 1 through 7 having a lateral air injection.

FIG. 8 shows another embodiment of an installation 100 with only washing vessel 104 being shown in detail which to a large extent corresponds to washing vessel 12 of the installation 10 according to FIGS. 1 through 7. Therefore, the following description shall only describe in detail the modified elements, and like elements are, therefore, identified with like numerals in FIG. 8.

Washing vessel 104, too, has a circular cross-section and is provided with a tube section 105 at its bottom which shall represent tube sections 46 and 85 of washing vessel 12 according to FIGS. 1 through 7.

Moreover, washing vessel 100 is provided with a drum 106 being rotatable about a horizontal axis 108 by means of a drive 107. Drum 106 contains hexagonal workpieces 100, 110'. . . . In the vicinity of cover 112, washing vessel 104 is provided with an overflow 111 being connected as well with second tank 16 containing cleaning fluid 42 as well as with first tank 14 containing rinsing fluid 47. Further, washing vessel 104 is connected with vacuum unit 18 via a lateral tube. For executing the vacuum-boiling method another tube section 114 may be provided in cover 112. The inner side of cover 112 is provided with a swell fountain 113 serving, as described above several times, to overflow workpieces 110 arranged within washing vessel 104 with a pressureless swell of fluid.

During the method step explained above in relation to FIG. 4, washing vessel 104 is filled with cleaning fluid 42 up to overflow 111. Washing vessel 104 receives a support 118 carrying several further workpieces 120.

An apparatus 122 for injecting gas (nitrogen is used in connection with the embodiment of FIG. 8) comprises a hollow body 126 having a bottom part 130 and a lateral part 131.

Lateral part 131 extends on one side of support 118 and encircles same at least about a large fraction of its periphery.

Hollow body 126 is provided with numerous openings at its side facing support 118, and according to the embodiment shown in FIG. 8, the openings are designed as jets 128.

Nitrogen from pressure tank 60 exits from jets 128 as fine pearls or bubbles 127 Bubbles 127, as described above, flow around workpieces 120 as indicated by arrow 136.

By providing for lateral part 131, a laterally directed bubble stream is generated, as indicated e.g. by arrow 139. The bubble stream flows along a curved line, because bubbles exiting from lateral jets 128 will tend to rise upwardly due to their buoyancy.

During a cleaning process the pressure under which gas bubbles 127 exit from lateral jets 128 is set such that bubbles 127 will at least reach the central axis of washing vessel (104) as indicated by arrow 138 in FIG. 8, where bubbles 127 flow at least over half the width in a lateral direction.

Lateral part 131 encircling support 118 at least partially, ensures that a fast cleaning is possible even for workpieces 120 of complicated design.

Hollow body 126 may be subdivided by means of separating slices 132, 133 into an upper section 134, a middle section 135 and a bottom section such that according to the kind of workpieces being contained in washing vessel 104 it is possible to either inject gas 141 from the bottom or, additionally, from one or more lateral sections being arranged one above the other.

The rising gas bubbles 127 generate a secondary flow as indicated by arrow 137. The liquid contained in washing vessel 104 therefore, will flow along a circular path.

Figure 10:
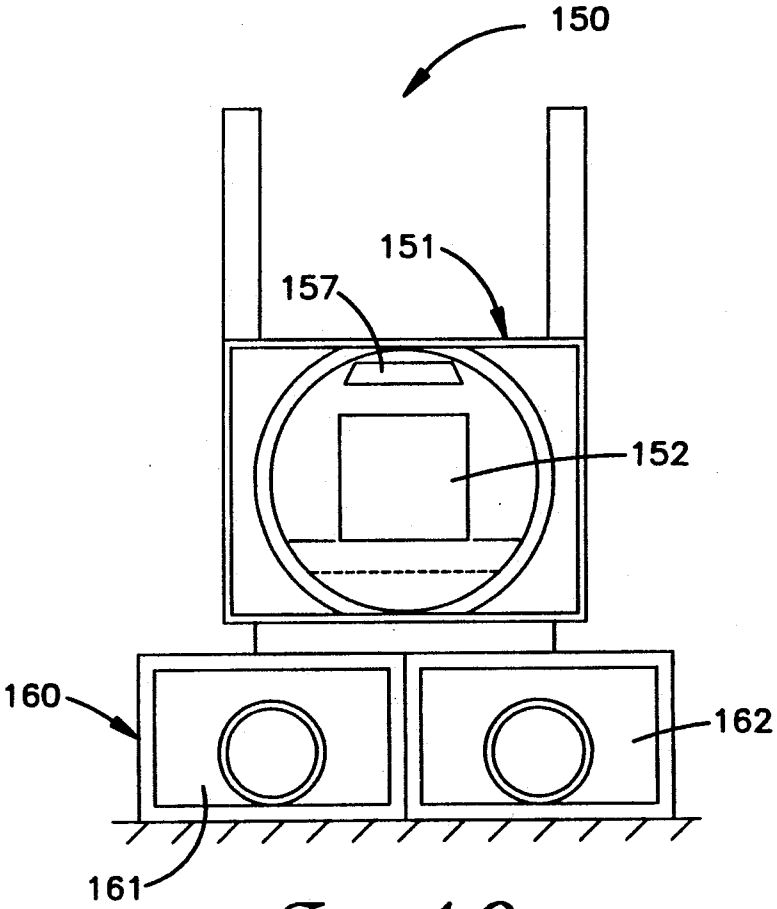
FIGS. 9 and 10 are an extremely schematic side and front elevational view of another embodiment of the inventive washing vessel, in horizontal design.
Figure 9:
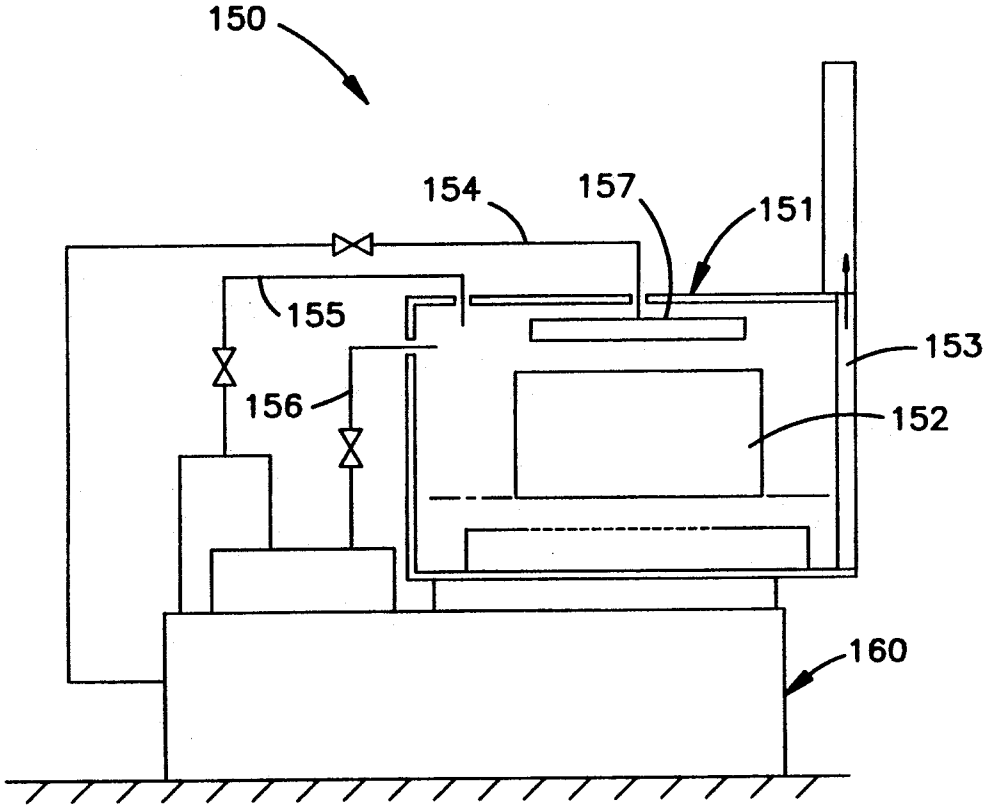

Finally, FIGS. 9 and 10 show still another embodiment of the apparatus according to the invention as can be used for performing the inventive method.

In FIGS. 9 and 10 150 is an installation preferably for the cleaning of metallic workpieces comprising a washing vessel 151. Washing vessel 151, again, comprises a support 152 for workpieces. However, in contrast to the embodiments of FIGS. 1 through 8 the arrangement is such that support 152 can be inserted or removed, respectively, via a loading door 153 in washing vessel 151. Loading door 153 is preferably displaceable along a vertical direction, as indicated by an arrow.

Via ducts 154, 155, 156 liquids and gases may be fed to and discharged from washing vessel 151, as described above in more detail. Insofar, there are no distinctions with respect to the particlar method used.

This holds true, in particular, for swell fountain 157 supplying a pressureless swell of water for installation 150, as described above for the other embodiments of the invention. However, according to the FIGS. 9 and 10 embodiment the area of direct action of pressureless water swell is somewhat larger in view of the horizontal design, as compared with the vertical arrangement of FIGS. 1 through 8.

Another feature of the installation 150 consists in that the washing vessel 151 is arranged on a crate 160 receiving concurrently tanks 161, 162 for treating fluids. In the embodiment shown two tanks 161, 162 for cleaning fluid and rinsing fluid, respectively, are provided.

It goes without saying that various modifications of the invention may be made without departing from the scope thereof. For example, it is possible to provide for an additional heating system in washing vessel 12 in order to be able to work with cooler workpieces or to be able to dry even in the presence of larger remaining fluid quantities because the additional heating may provide for the additional thermal quantities needed for evaporating larger remaining fluid quantities.

Moreover, it is possible to provide for ultrasonic generators within washing vessels 12 in order to generate cavitations in the treating fluid by extreme physical forces. In this way it it possible to remove unorganic substances tightly adhering the workpieces as well as pollutants and dirt that has dug into the workpiece surface.

Thus, the present invention has been described herein with reference to particular embodiments for particular applications. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A method for treating workpieces with a fluid, in particular for cleaning metallic workpieces prior to a subsequent heat treatment, the method comprising the steps of:

(a) positioning of said workpieces in a washing vessel having a capacity between 1 $m^3$ and 10 $m^3$:

(b) closing said washing vessel;

(c) entirely overflowing said workpieces with a pressureless swell of a first treating fluid, preferably a cleaning fluid, having a temperature between 50° C. and 90° C., said swell being set to a flow rate between 100 and 300 cubic meters per hour per square meter of workpiece surface, for a duration of between 1 and 10 minutes, said first treating fluid being continuously discharged from said washing vessel via an outlet tube;

(d) closing said outlet tube and allowing said washing vessel to be filled by said swell up to an overflow;

(e) reducing said flow rate by 30 to 80%;

(f) injecting gas from a bottom of said washing vessel for letting gas bubbles flow around said workpieces, for a duration of between 3 and 15 minutes;

(g) opening said outlet tube and simultaneously increasing said flow rate up to 80% to 100% according to step (c) for allowing said washing vessel to discharge;

(h) concurrently with steps (c) through (g) continuously cleaning and recycling said first treating fluid discharged or overflowing, respectively, from said washing vessel and;

(i) air-tight closing said washing vessel and generating therein a vacuum between 60 and 350 mbar, for a duration of between 3 and 10 minutes.

2. The method of claim 1, further comprising the step of;

(h') repeating steps (c) through (h) at least one time with a second treating fluid, subsequent to a first iteration of step (h) and prior to step (i).

3. The method of claim 2, wherein a desalinated water is used as said second treating fluid, a washing agent being added to said desalinated water after step (h') for being used as a washing fluid during a subsequent execution of said method.

4. The method of claim 1 wherein a bubble stream is generated having bubbles with a diameter of about 1 mm.

5. The method of claim 4, further comprising the step of;

(h') repeating steps (c) through (h) at least one time with a second treating fluid, subsequent to a first iteration of step (h) and prior to step (i).

6. The method of claim 1 wherein said gas is injected into said fluid with a pulsed increased pressure.

7. The method of claim 6, further comprising the step of;

(h') repeating steps (c) through (h) at least one time with a second treating fluid, subsequent to a first iteration of step (h) and prior to step (i).

8. The method of claim 1 wherein said gas is air.

9. The method of claim 8, further comprising the step of;

(h') repeating steps (c) through (h) at least one time with a second treating fluid, subsequent to a first iteration of step (h) and prior to step (i).

10. The method of claim 1 wherein said gas is a protective gas showing no chemical reactions with surfaces of said workpieces and/or dies not assist such chemical reactions.

11. The method of claim 10, further comprising the step of;

(h') repeating steps (c) through (h) at least one time with a second treating fluid, subsequent to a first iteration of step (h) and prior to step (i).

12. The method of claim 1 wherein said cleaning fluid is water, a soft, grease-solvent cleaning agent being added to said water, said cleaning agent showing no chemical reactions with surfaces of said workpieces and/or does not assist such chemical reactions.

13. The method of claim 12 wherein said cleaning agent is neutral or alkaline.

14. The method of claim 13, further comprising the step of;

(h') repeating steps (c) through (h) at least one time with a second treating fluid, subsequent to a first iteration of step (h) and prior to step (i).

15. The method of claim 12, further comprising the step of;

(h') repeating steps (c) through (h) at least one time with a second treating fluid, subsequent to a first iteration of step (h) and prior to step (i).

16. The method of claim 1 wherein said injected gas has the same temperature as said treating fluid.

17. The method of claim 16, further comprising the step of;

(h') repeating steps (c) through (h) at least one time with a second treating fluid, subsequent to a first iteration of step (h) and prior to step (i).

18. The method of claim 1 wherein said workpieces is a bulk material and is filled in a fluid-permeable drum, said drum being immersed in said treating fluid with said bubbles passing therethrough.

19. The method of claim 18, further comprising the step of:

(h') repeating steps (c) through (h) at least one time with a second treating fluid, subsequent to a first iteration of step (h) and prior to step (i).

* * * * *